United States Patent [19]

Irvine

[11] 4,454,973

[45] Jun. 19, 1984

[54] PERFORATION BURST CONE DEVICE

[75] Inventor: Robert Irvine, Riverside, Conn.

[73] Assignee: Pitney Bowes Inc., Stamford, Conn.

[21] Appl. No.: 444,569

[22] Filed: Nov. 26, 1982

[51] Int. Cl.[3] ..... B65H 35/10

[52] U.S. Cl. ..... 225/100; 225/4

[58] Field of Search ..... 225/100, 4, 5; 270/52.5

[56] References Cited

U.S. PATENT DOCUMENTS

| | | | |
|---|---|---|---|
| 2,375,542 | 5/1945 | Euth | 225/100 |
| 3,135,446 | 6/1964 | Sargent | 225/100 |
| 3,146,927 | 9/1964 | Peterson | 225/100 |
| 3,672,551 | 6/1972 | Peterson | 225/100 |
| 4,261,497 | 4/1981 | Roetter et al. | 225/100 |

FOREIGN PATENT DOCUMENTS 731595 6/1955 United Kingdom .

*Primary Examiner*—Frank T. Yost

*Attorney, Agent, or Firm*—Melvin J. Scolnick; Albert W. Scribner; William D. Soltow, Jr.

[57] ABSTRACT

A bursting apparatus for separating sheets in a continuous intermittently perforated form web is disclosed. The apparatus includes a feed roller, a burst roller and a bursting device, said bursting device disposed between said feed roller and said burst roller and comprising two horizontally positioned cone sections wherein their base portions are adjacent to each other and are encircled at least in part by a bursting ring, said bursting ring having a portion extending beyond said cone base portions in at least a portion of its outer periphery.

9 Claims, 4 Drawing Figures

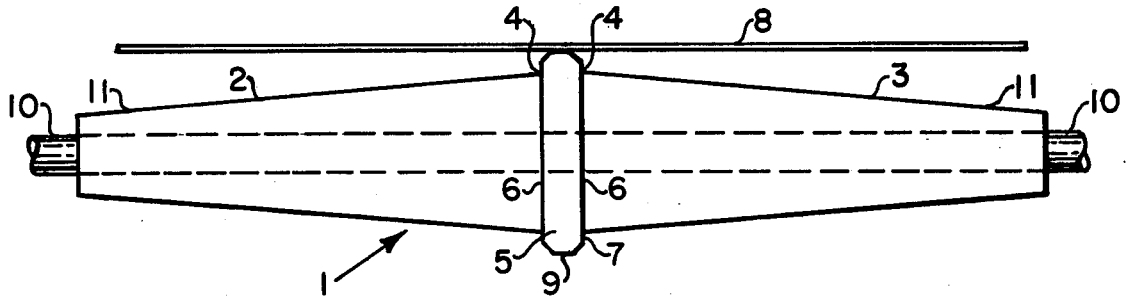
FIG. 1
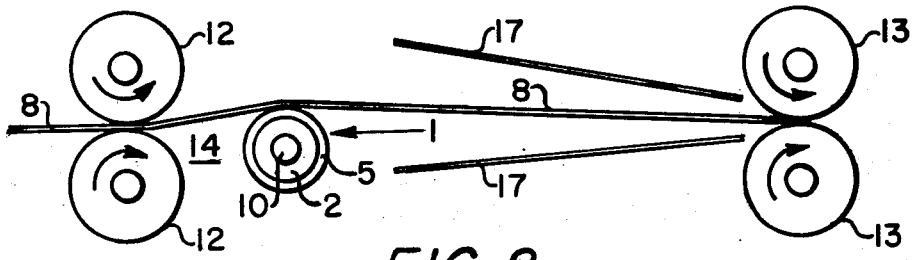
FIG. 2
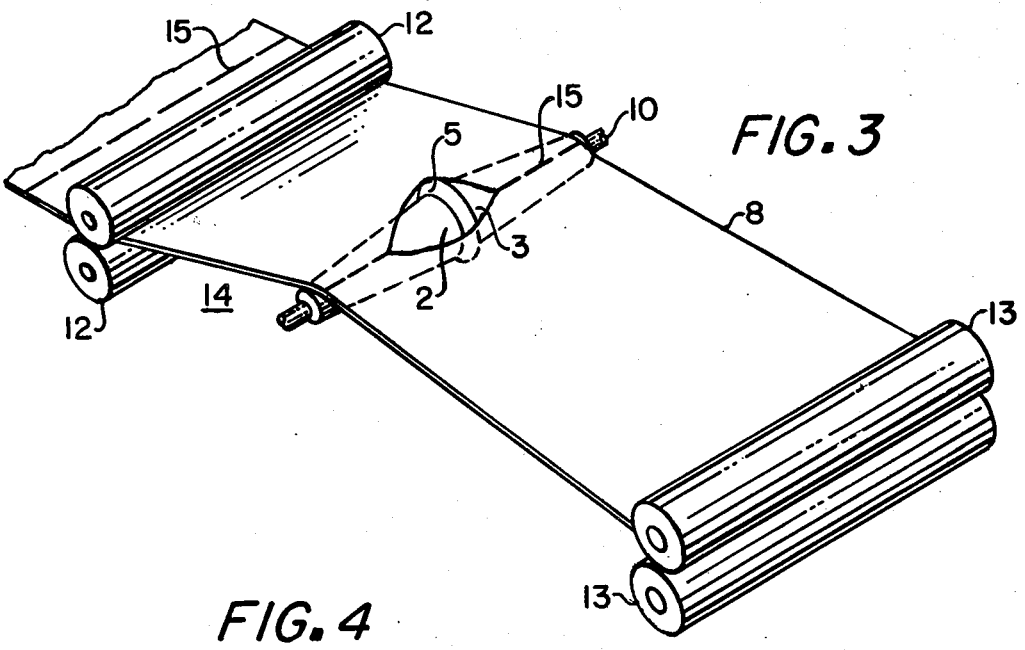
FIG. 3
FIG. 4
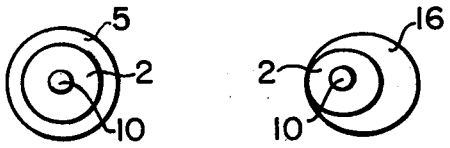

PERFORATION BURST CONE DEVICE

This invention relates to a device for separating perforated sheets from a continuous web of paper and, more specifically, to a form bursting mechanism for accomplishing this bursting process.

BACKGROUND OF THE INVENTION

It is known to use in various data processing systems or in output printers a continuous sheet or web of paper, having individual sheets separated by perforations. After the information is conveyed to the sheet in any type of marked form, it is desired to separate these sheets for proper routing or dissemination. When the printing operation is completed, various bursting or sheet separating devices are used to tear the individual sheetings along the perforations and thereby separate them for further individual processing.

There are other type of paper separating machines that do not tear or separate by bursting a perforation but rather cut the sheets to a predetermined length, and then stack, collate or separate the sheets for subsequent processing. This type of device is often used in copiers or printers where paper roll is used and various lengths of printed or output sheets are desired. In high speed operations, such as in computer printers, electronic scanning apparatus or data processing equipment, this paper cutting operation is too slow and does not lend itself to be adapted for these uses. Instead most high speed electronic data processing systems utilize a continuous web of perforated sheets that are separated by various means or devices. Some of these devices include relatively expensive machine equipment that are difficult to maintain because of their complexity. Other devices containing bursting mechanisms for separating continuous webs have been found to be effective in the initial bursting of the perforation, but somewhat deficient in completing the tear along the remainder of the sheet.

Generally, the devices used commercially for separating continuous form webs comprise a three station or unit device; an inlet roller, an outlet roller, and intermediate said rollers a form bursting means. These devices generally program the inlet rollers at a speed less that the speed of the outlet rollers. Systems such as these are disclosed in U.S. Pat. Nos. 4,145,035; 4,118,022; 4,025,023; 3,968,916; 3,888,399 and 3,847,318. In these systems the continuous form web or strip is effectively pulled so that the pre-weakened portions or perforations transversely extending across the paper will become severed. The individual sheets then are collected at an outlet station after the outlet rollers. The burster station located intermediate the rollers is utilized to initiate the tear in the perforations or pre-weakened portions of the web. In computer output printer operations where the web speed-through is extremely fast, the bursting operation becomes a critical point in the entire process. Of additional importance to the initiation of the bursting process is the continuation of the tear to insure that the sheets are separated completely from the remainder of the paper web. Not only are the effectiveness of the bursting and complete tearing operations important, but as computer output printers progress in accelerated through-put, of equal importance is the speed of this paper separation. Many of the bursters known are not readily adaptable to this high speed operation nor can they be relied upon to perform effectively without operator attention at these maximum speeds. Additional drawbacks of heretofore known systems are the noise, reliability, bulkiness, and complexity of the bursting mechanisms. The present invention provides a novel mechanism that combines both the initial burst or paper breakthrough and the continuing tearing of the paper along the perforated edges. Also present in this invention is a relatively simple reliable structure for effectuating the separation required in the modern high speed processings systems in use commercially.

There are generally three burster mechanisms in use today embodied in separating equipment for continuous forms. In one embodiment, positioned between the input rollers and the output rollers is a bursting mechanism comprising axially mounted spheres to initiate the bursting process along the transverse lines of weakening of the web. In this prior art system, the web is fed between two pairs of feed rollers. A breaker roller is located in the path of travel between the two pairs of feed rollers for increasing tension along the line of web perforations and causing the webs to rupture along that line. A brake and clutch mechanism are connected to the first feed rollers to halt or slow these rollers at a predetermined time. The second set of feed rollers (or output rollers) are maintained at a fixed rotation thereby causing the tension resulting on the perforated web adjacent to the spheres to rupture. The most significant drawback to this type mechanism is that the spheres or burst balls do not effectuate a finished tear across the entire width of the web or perforation.

In the second embodiment used in the prior art, a V-shaped blade is positioned horizontally to the paper flow whereby the trip of the V will puncture through the perforations to initiate the separation. While this system generally does complete the tear across the paper width, it does not always successfully tear along the perforations.

In a further system used in the prior art, the output rollers are provided with a greater diameter than the diameter of the input rollers. Since it is usual that the output rollers are programmed at a speed in excess of the speed of the input rollers, this prior art system provided an approach where the diameter difference was substituted for the differential in speed to accomplish the longitudinal force required to burst the web perforations. This and some other known systems are not easily installed into existing high speed systems and suffer in cost due to complexity and difficulty in adaptations to present systems.

SUMMARY OF THE INVENTION

It is therefore an object of the present invention to provide a bursting apparatus and system devoid of the above noted disadvantages.

Another object of this invention is to provide a sheet separating mechanism readily adaptable for use in present high speed output printers.

Another further object of this invention is to provide a relatively simple bursting apparatus means that is economical to manufacture and install.

Another still further object of this invention is to provide a reliable paper forms separating system for systems irrespective of the specifications of the perforations.

Still a further object of this invention is to provide a bursting apparatus that can accomplish the bursting step in paper of various thicknesses.

These and other objects are accomplished in accordance with this invention by providing a novel device for reliably separating forms from a continuous web. In this system, a continuous forms web is fed by the first or forms feed rollers which have been adjusted so that as the lead edge of the form reaches the burst rollers, the perforation is directly over the novel burst means of this invention. The burst means is positioned in the system after the first or forms feed rollers but before a second set of rollers called the burst roller. This bursting means comprises two cone shaped rollers connected at their base or widest portion and tapering down outwardly from the center. Positioned between the bases of the cones is a burst ring which extends beyond the outer periphery of the bases. The ring must have a diameter greater than the diameter of the cone bases. The second or burst rollers are traveling faster than the linear speed of the forms feed rollers. This speed differential draws the form taut over the burst ring which results in the ring breaking through the perforation. The cones continue the separating action because of their tapered configuration and the form continually being drawn taut. The tearing of the perforations occurs continuously down along the tapered surface of the cones until all perforations are separated. Once the burst ring has initiated the tear, together with the speed differential of the rollers, a longitudinal tension results which promotes tearing along the perforations. The paper tightly follows the contour of the cones and tears from the high spot of the ring down through the cone contour until the entire page is separated. Thus, the speed differential of said feed rollers and said burst rollers renders the continuous web to follow the cone contour and it becomes taut as the transverse perforations pass over the burst or tearing ring. Basically, the apparatus and system disclosed in U.S. Pat. No. 4,261,497 is followed in the present invention, except a novel bursting element replaces the elements 32 and 34 of the apparatus disclosed in U.S. Pat. No. 4,261,497. In the present case the cones are substituted for elements 32 and 34 and provide for a more efficient system. The cones continue the separating action, after the initial bursting, because of their tapered configuration and the form continually being drawn taut.

BRIEF DESCRIPTION OF THE DRAWINGS

FIG. I is an enlarged front view of the bursting apparatus of this invention illustrating the relationship with the continuous web of forms.

FIG. II is a schematic side view representation of the feed rollers, bursting apparatus, bursting rollers and the general system of this invention illustrating the path of the web of forms therethrough.

FIG. III is an enlarged conceptual isometric view of the bursting apparatus as it performs both the initial bursting and the continuing tearing of the forms.

FIG. IV is a schematic side view showing the configuration of alternate burst rings for use in this invention.

DESCRIPTION OF THE PREFERRED EMBODIMENT

The bursting mechanism and system of this invention utilizes several conventional elements of a burster for a continuous web of perforated paper. The differential in speed between the rollers, for example, is disclosed in U.S. Pat. Nos. 4,261,497 and 4,222,511. In FIG. I the novel bursting apparatus 1 is shown. This burster can be easily and conveniently adapted for use in any of the prior art systems having a roller speed differential. Burster 1 comprises two cone sections 2 and 3 that are connected or otherwise joined horizontally at their base portions 4 to form a double conical bursting device. Positioned between each cone is a burst ring 5 that extends outwardly beyond the circumference of each base portion 4. The burst ring 5 may encircle base portions 4, or may be constructed as a disc having base portions 4 attached to the face portions 6 of the disc. It is important that burst ring 5 have a raised or protruding portion or portions 7 which initially contacts paper or web of forms 8 as the bursting process is initiated. The outer peripheral portion 9 of burst ring 5 may be of any suitable configuration. While the face or portion 9 is shown as flat, a rounded face would also be suitable for use in this invention. Cones 2 and 3 are tapered away from the center portion where burst ring 5 is located. As the burst ring 5 penetrates through the perforations the resulting longitudinal tension promotes tearing along the perforations as the web of forms 8 adhere to the contour of cones 2 and 3. Since there is a pulling effect upon paper web 8 because of the roller speed differential and the positioning of the bursting mechanism 1 along the web or paper path, the paper will follow the outline of the cones 2 and 3 and because of the bursting tension formed will separate at its weakened portions or perforations. Guide plates 17 direct the broken end portions of sheet 8 into the rollers 13 after the bursting step. Cones 2 and 3 are rotably mounted around mounting shaft 10, and terminate at their tapered portions 11 to form the outer dimensions of bursting apparatus 1.

Referring now to FIG. II, it is apparent from the drawing that bursting apparatus 1 extends above the normal plane of the paper or web path. As the web 8 leaves forms feed rollers 12 it travels upwardly to bursting apparatus 1 where burst ring 5 initially penetrates through the perforations and tears along the contour of cone 2. Since the speed of burst rollers 13 exceeds the speed of feed rollers 12, and with the slightly elevated position of bursting apparatus 1, a pulling action is imparted to form web 8 causing the web to hug the contour of the cones 2 and 3 and tear along its weakened portions. The preferred speed differential is when the burst rollers 13 are traveling at about twice the linear speed of the forms feed rollers 12.

In FIG. III web 8 passes through feed rollers 12 in a slightly inclined path as shown at 14. As web 8 reaches the burst ring 5, its perforations 15 are penetrated by ring 5 and because of the lateral tension tearing is promoted along the remaining perforations at a line along the contours of cones 2 and 3. After the paper separation is completed, the paper can continue on to any number of different stations such as a folding station or machine, a collecting station, or an inserting station or device. Any suitable material may be used to construct the apparatus of this invention, however it is preferred that aluminum be used because of its light weight, its good machinability, and its relatively low cost.

In FIG. IV, two alternate burst rings are illustrated for use in this invention. Burst ring 5 is of a circular configuration as shown additionally in FIGS. I–III. The periphery of cone 2 is exceeded by ring 5 by the same amount throughout the entire adjacent circumference of the cone 2. In the alternate embodiment shown in this figure, ring 16 is eccentrically shaped and extends beyond the periphery of cone 2 in an irregular fashion. An advantage of this type of ring is to accomodate bursting of thicker paper. In use, this is accomplished by rotating mounting shaft 10 until the desired portion of ring 16 is in an upright position for bursting and then locking shaft 10 in position by any suitable means. The configuration of ring 16 can be altered in any way desired so as to best accomplish the bursting step in papers of various thicknesses. While ring 16 is shown in an eliptical form herein, it could be of any suitable configuration so long as at least a portion of the ring extends beyond the periphery of the cone 2.

Various modifications and ramifications will become apparent to those skilled in the art upon a reading of this disclosure; these are intended to be encompassed within the spirit of this invention.

What is claimed is:

1. A bursting apparatus for separating sheets in a continuous intermittently perforated form web comprising: feed roller means, burst roller means and a bursting device, said bursting device disposed between said feed roller means and said burst roller means and comprising two horizontally positioned cone sections wherein their base portions are adjacent to each other and are encircled at least in part by a bursting ring, said bursting ring has a portion extending beyond said cone base portions in at least a portion of its outer periphery.

2. The apparatus of claim 1 wherein said burst roller is traveling at a speed in excess of the linear speed of said feed rollers.

3. The apparatus of claim 1 wherein said apparatus is programmed to provide that said perforations are directly above said burst ring as the lead edge of said form reaches said burst roller.

4. The apparatus of claim 1 wherein said bursting ring is positioned between and around said base portions.

5. The apparatus of claim 1 wherein said bursting ring is a concentric ring configuration encircling and extending at least in part beyond the outer periphery of said base portions.

6. The apparatus of claim 1 wherein said bursting ring is of a circular configuration wherein it extends equidistantly beyond the total outer periphery of said base portions.

7. The apparatus of claim 1 wherein said bursting ring is of an eliptical configuration wherein it extends irregularly beyond the outer periphery of said base portions.

8. The apparatus of claim 1 wherein said bursting device is positioned on a plane in the form web travel path slightly higher than the plane of said rollers.

9. The apparatus of claim 1 wherein said bursting rollers have a speed about twice the linear speed of said feed rollers.

* * * * *